US007545945B2

(12) United States Patent
Miles

(10) Patent No.: US 7,545,945 B2
(45) Date of Patent: Jun. 9, 2009

(54) COMB SENSE MICROPHONE

(75) Inventor: Ronald Miles, Newark Valley, NY (US)

(73) Assignee: The Research Foundation of the State University of New York, Binghamton, NY (US)

( * ) Notice: Subject to any disclaimer, the term of this patent is extended or adjusted under 35 U.S.C. 154(b) by 804 days.

(21) Appl. No.: 11/198,370

(22) Filed: Aug. 5, 2005

(65) Prior Publication Data

US 2007/0297631 A1 Dec. 27, 2007

(51) Int. Cl.
*H04R 25/00* (2006.01)

(52) U.S. Cl. ..... 381/174; 381/190; 381/430

(58) Field of Classification Search ..... 381/171, 381/173–178, 181–182, 190–191, 427, 431
See application file for complete search history.

(56) References Cited

U.S. PATENT DOCUMENTS 5,839,062 A 11/1998 Nguyen et al.
5,952,974 A 9/1999 Ito et al.
5,955,668 A 9/1999 Hsu et al.
6,257,059 B1 7/2001 Weinburg et al.
6,578,420 B1 6/2003 Hsu
6,788,796 B1 9/2004 Miles et al.
6,928,720 B2 * 8/2005 Kobayashi et al. ..... 29/594
6,963,653 B1 * 11/2005 Miles ..... 381/431
2002/0189352 A1 12/2002 Reeds et al.
2004/0231420 A1 11/2004 Xie et al.
2005/0051910 A1 3/2005 Goto et al.
2005/0072231 A1 4/2005 Chojnacki et al.
2005/0109107 A1 5/2005 Park

* cited by examiner

*Primary Examiner*—Suhan Ni
(74) *Attorney, Agent, or Firm*—Milde & Hoffberg LLP

(57) ABSTRACT

There is provided a rigid hinged substrate, which forms a diaphragm for miniature microphones. A series of fingers disposed radially around the perimeter of the diaphragm interacts with mating fingers disposed adjacent the diaphragm with a small gap in between. The fingers are interdigitated. The movement of the diaphragm fingers relative to the fixed fingers varies the capacitance, thereby allowing creation of an electrical signal responsive to varying sound pressure at the diaphragm. Because the fingers may be formed with great stiffness, the classic problem in typical capacitive microphones of attraction of the diaphragm to the back plate is effectively overcome. The multiple fingers allow the creation of a microphone having a high output voltage relative to conventional microphones. This yields a very low noise microphone. The diaphragm may be readily formed using well known silicon microfabrication techniques so as to reduce manufacturing costs.

18 Claims, 11 Drawing Sheets

COMB SENSE MICROPHONE

STATEMENT OF GOVERNMENT INTEREST

This invention was made with Government support under R01DC005762 awarded by the National Institute of Health. The Government has certain right in the invention.

RELATED APPLICATIONS

This application is related to U.S. patent application Ser. No. 09/920,664, filed Aug. 1, 2001, titled DIFFERENTIAL MICROPHONE, now issued as U.S. Pat. No. 6,788,796, and application Ser. No. 10/302,528 filed Nov. 25, 2002, titled ROBUST DIAPHRAGM FOR AN ACOUSTICAL DEVICE and U.S. patent application Ser. No. 10/691,059, filed Oct. 22, 2003, titled HIGH-ORDER DIRECTIONAL MICROPHONE DIAPHRAGM, all of which are included herein in their entirety by reference.

FIELD OF THE INVENTION

The invention pertains to capacitive microphones and, more particularly to capacitive microphones having rigid, silicon diaphragms with a plurality of fingers interdigitated and interacting with corresponding fingers of an adjacent, fixed frame.

BACKGROUND OF THE INVENTION

A common approach for transducing the motion of a microphone diaphragm into an electronic signal is to construct a parallel-plate capacitor where a fixed electrode (usually called a back plate) is placed in close proximity to a flexible (i.e., movable) microphone diaphragm. As the flexible diaphragm moves relative to the back plate in response to varying sound pressure, the capacitance of the microphone varies. This variation in capacitance may be translated to an electrical signal using a number of well known techniques. One such method is shown in FIG. 1 which is a schematic diagram of a typical capacitor (condenser) microphone 100 of the prior art. A fixed back plate 102 is spaced apart a distance d 106 from a flexible diaphragm 104. A DC bias voltage Vb is applied across back plate 102 and diaphragm 104.

An amplifier 110 has an input electrically connected to diaphragm 104 so as to produce an output voltage Vo in response to movement of diaphragm 104 relative to back plate 102. Because the output signal Vo is proportional to bias voltage Vb, it is desirable to make Vb as high as possible so as to maximize output signal voltage Vo of microphone 100.

Unfortunately, the bias voltage Vb exerts an electrostatic force on diaphragm 104 in the direction of the back plate. This limits the practical upper limit of the bias voltage Vb. This electrostatic force, f, is given by the equation:

$$f = \frac{d}{dx}\left(\frac{1}{2}CV_b^2\right) \tag{1}$$

where C is the capacitance of the microphone which may also be expressed:

$$C = \frac{\varepsilon A}{d + x} \tag{2}$$

where: $\epsilon$ is the permittivity of air ($\epsilon$=8.86×10$^{-12}$ farads/meter);

A is the area of the diaphragm 104 of the microphone;

d is the nominal distance 106 between the back plate 102 and the diaphragm 104; and x is the displacement of the diaphragm, a positive value indicating displacement away from the back plate 102.

Combining Equations (1) and (2) yields:

$$f = \frac{-V_b^2 \varepsilon A}{2(d + x)^2} \tag{3}$$

It will be noted that regardless of the polarity of Vb, this electrostatic force f acts to pull diaphragm 104 towards back plate 102. If Vb is increased beyond a certain magnitude, diaphragm 104 collapses against back plate 102. In order to avoid this collapse, the diaphragm must be designed to have sufficient stiffness. Unfortunately, this requirement for diaphragm stiffness conflicts with the need for high diaphragm compliance necessary to ensure responsiveness to sound pressure.

Because in microphones of this construction, electrostatic force f does not vary linearly with x, distortion of the output signal relative to the sensed acoustic pressure typically results.

Yet another problem occurs in these types of microphones. The presence of back plate 102 typically causes excessive viscous damping of the diaphragm 104. This damping is caused by the squeezing of the air in the narrow gap 106 separating the back plate 102 and the diaphragm 104.

The comb sense microphone of the present invention overcomes all of these shortcomings of microphones of the prior art.

SUMMARY OF THE INVENTION

In accordance with the present invention there is provided an ultra-miniature microphone incorporating a rigid silicon resiliently supported substrate which forms a diaphragm. A series of fingers disposed around the perimeter of the diaphragm interacts with mating fingers disposed adjacent the diaphragm fingers with a small gap in between. In other words, the fingers are interdigitated. The movement of the diaphragm fingers relative to the fixed fingers varies the capacitance, thereby allowing creation of an electrical signal responsive to a varying sound pressure at the diaphragm. Because the electrostatic force on the fingers does not have a significant dependence on the out-of-plane displacement of the diaphragm, the classic problem of attraction of the diaphragm to the back plate discussed hereinabove is effectively overcome. The diaphragm can be designed to be very compliant without creating instabilities due to electrostatic forces. The multiple fingers allow creation of a microphone having a high output voltage relative to microphones of the prior art. This, in turn, allows creation of very low noise microphones.

The diaphragm is readily formed using well-known silicon microfabrication techniques to yield low manufacturing costs.

It should be noted that many capacitive sensors utilize interdigitated comb fingers. The primary uses of this sensing approach are in silicon accelerometers and gyroscopes well known to those of skill in those arts. Such sensors generally consist of a resiliently supported proof mass that moves relative to the surrounding substrate due to the motion of the substrate. An essential feature of these constructions is that the proof mass is supported only on a small fraction of its perimeter, allowing a significant portion of the perimeter to be available for capacitive detection of the relative motion of the proof mass and the surrounding substrate through the use of comb fingers. This requirement has precluded the use of comb fingers for capacitive sensing in microphones because the typical approach to the formation of a microphone diaphragm is to construct a very thin plate that is effectively clamped along its entire perimeter. Because silicon accelerometers and gyroscopes utilize compliant hinges rather than entirely clamped perimeters, they readily permit the use of comb fingers for sensing.

BRIEF DESCRIPTION OF THE DRAWINGS

A complete understanding of the present invention may be obtained by reference to the accompanying drawings when considered in conjunction with the subsequent detailed description, in which.

DETAILED DESCRIPTION OF THE PREFERRED EMBODIMENT

Figure 1:
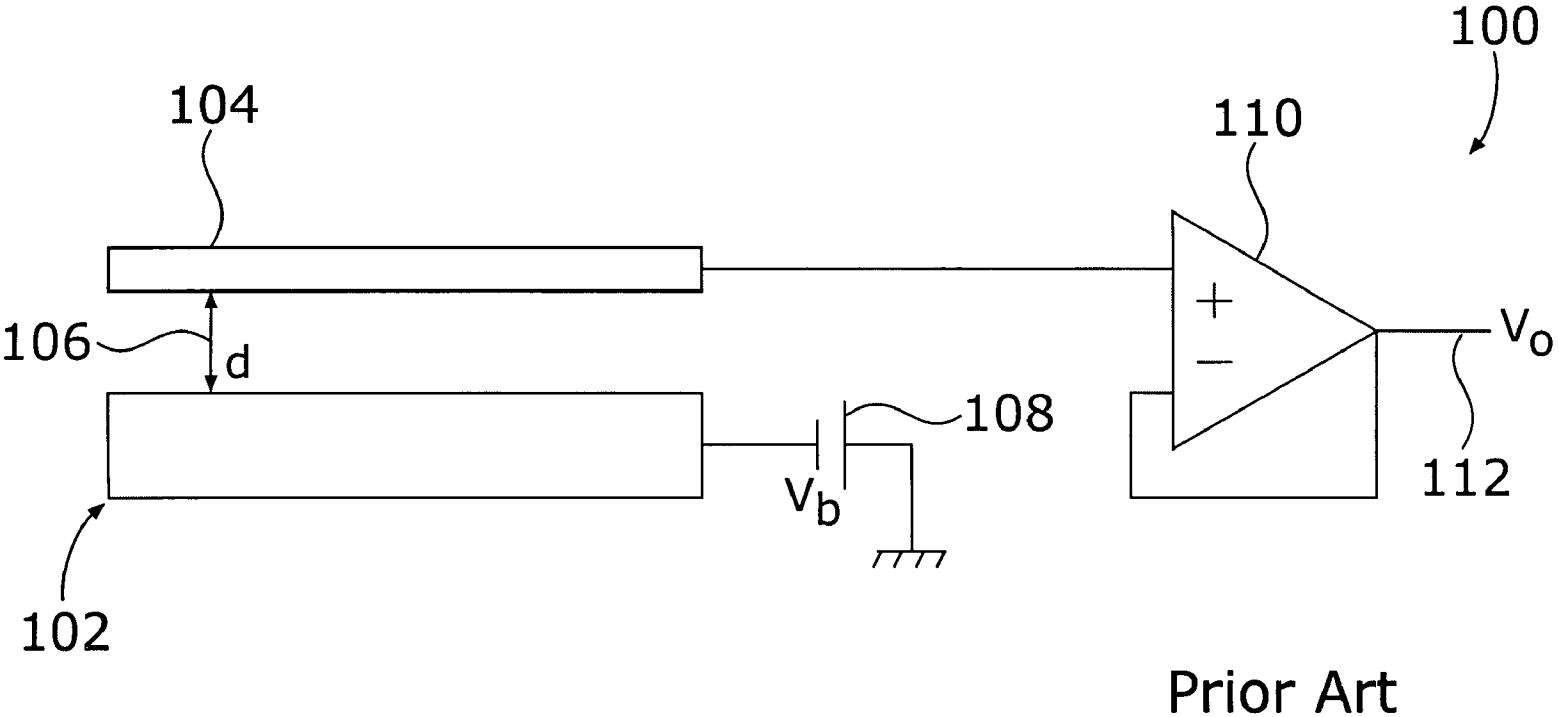
Prior Art Figure 1
FIG. 1 is an electrical schematic diagram of a typical capacitive microphone of the prior art.

A highly efficient capacitance microphone that overcomes the deficiencies of classic capacitance microphones of the prior art described hereinabove may be formed by making a diaphragm having a series of fingers disposed around its perimeter. These fingers are then interdigitated with corresponding fingers on a fixed structure analogous to a back plate in microphone 100 (FIG. 1).

Figure 2A:
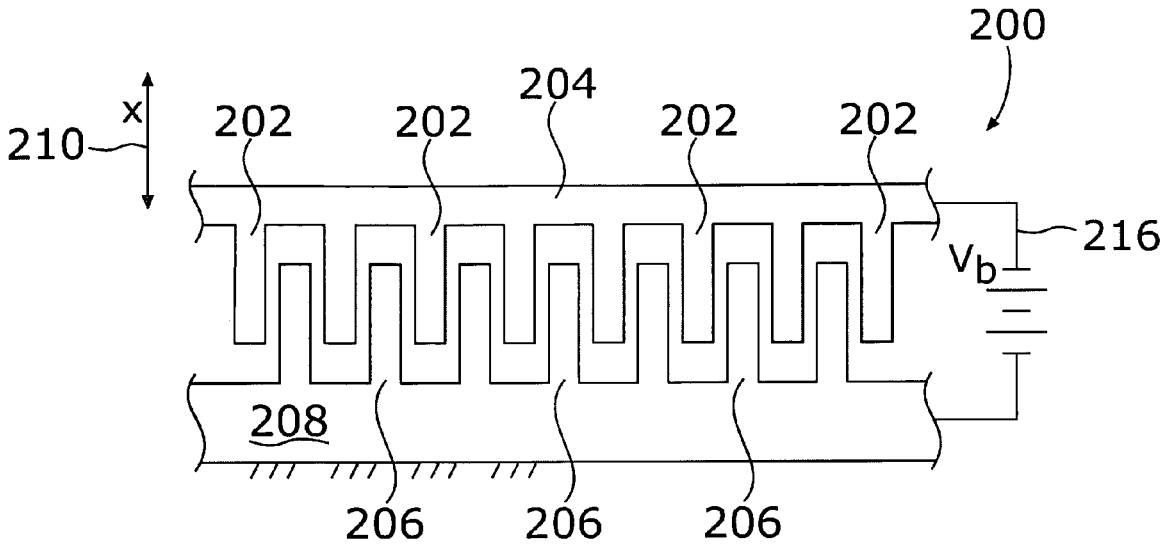
FIG. 2*a* is a schematic, plan view of an interdigitated finger structure suitable for use in the microphone of the invention.

Referring now to FIG. 2*a*, there is shown a schematic cross-sectional view of an interdigitated finger structure, generally at reference number 200. A series of fingers 202 projects from the surface of a substrate 204. The surface of substrate 204 is free to move out of the plane of the figure and forms the diaphragm of a microphone. Additional fingers 206 project from the surface of a fixed structure 208 representative of a microphone back plate. Fingers 202 projecting from diaphragm 204 are free to move with the diaphragm out of the plane of the figure as well as in the direction x indicated by arrow 210 relative to the fixed structure 208.

Figure 2B:
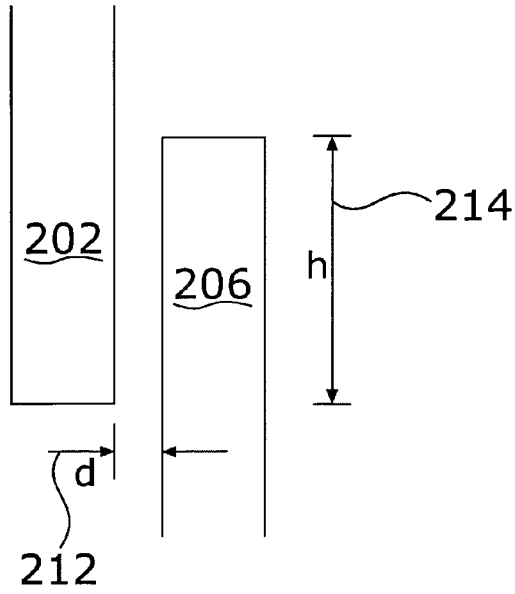
FIG. 2*b* is a detailed schematic end view of one finger pair of the interdigitated finger structure of FIG. 2*a;*

Referring now also to FIG. 2*b*, there is shown an end view of a portion of the fingers of FIG. 2*a* showing one each of fingers 202, 206. Fingers 202 and 206 are separated by a gap d 212. Fingers 202 and 206 may overlap one another a distance h 214.

Each finger 202, 206 has a length l (not shown) in a direction perpendicular to the cross-sectional view of FIG. 2*b*. The length l of each finger depends on several factors such as the available area of the diaphragm 204, and on other practical fabrication considerations.

The total capacitance C of a microphone structure using the interdigitation technique of FIGS. 2*a* and 2*b* may be roughly estimated by:

$$C = \frac{\varepsilon(h-x)}{d} l2N, \tag{4}$$

where x is the displacement of the diaphragm, and N is the number of fingers. In equation (4) it is assumed that the nominal overlap distance is h 214 as shown in FIG. 2*b*. It should be noted that it is not essential that the fingers overlap with h being a positive value. In this case, however, the capacitance will not be accurately estimated by equation (4) and must be estimated by other means.

If a bias voltage Vb 216 (FIG. 2*a*) is then applied between diaphragm 204 and back plate 208, Equations (1) and (4) show the resulting electrostatic force f to be:

$$f = \frac{d}{dx}\left(\frac{1}{2}\frac{\varepsilon(h-x)}{d} l2NV_b^2\right) = -\frac{\varepsilon}{d} lNV_b^2. \tag{5}$$

Equation (5) clearly shows that the nonlinear dependence of f on x (Equation 3) for the parallel plate microphone 100 (FIG. 1) of the prior art no longer exists. Consequently, bias voltage Vb has only a minimal effect on the dynamic response of the interdigitated diaphragm 204 and does not affect the stability of the diaphragm's motion in the x direction; a significantly higher bias voltage Vb may be used without a need to increase diaphragm stiffness, resulting in increased microphone sensitivity without the diaphragm collapse problems of prior art microphones.

Figure 3:
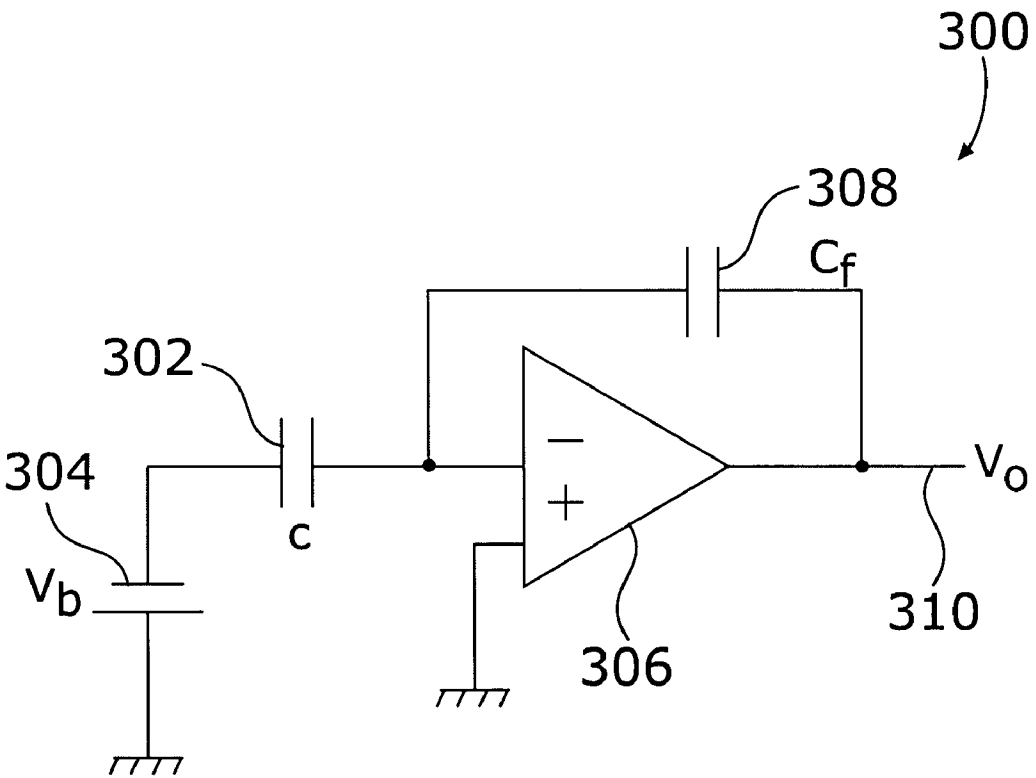
FIG. 3 is an electrical schematic diagram of a capacitive microphone in accordance with the invention.
Figure 4:
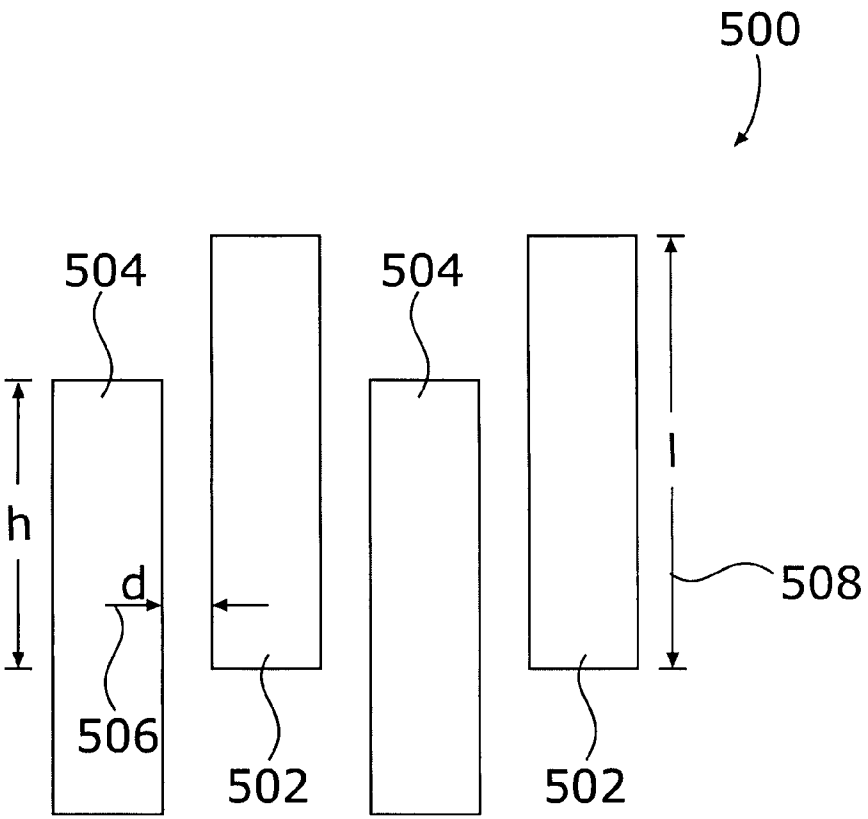
FIG. 4 is an end view of two pairs of interdigitated fingers.

One possible way to obtain an electrical signal from a capacitive microphone is shown in the circuit of FIG. 3, generally at reference number 300. A capacitive microphone 302 has a bias voltage Vb 304 applied to one electrical connection thereof. The second electrical connection of microphone 304 is connected to the negative (–) input of an operational amplifier 306, the + input of operational amplifier 306 being connected to ground. A feedback capacitor Cf 308 is connected between the output of amplifier 306 and the – input thereof. Because C may be expressed by Equation (4), the output voltage Vo 310 of amplifier 306 is:

$$V_o = -V_b\frac{C}{C_f} = \frac{-V_b}{C_f}\left(\varepsilon(h-x)\frac{l2N}{d}\right) \tag{6}$$

where Cf 308 is the feedback capacitance. The output voltage Vo 310 given by Equation (6) may be separated into DC and AC components:

$$V_o = \frac{-V_b}{C_f}\varepsilon hl\frac{2N}{d} + x\frac{V_b}{C_f}\varepsilon l\frac{2N}{d} \tag{7}$$

which varies linearly with the displacement x of the microphone diaphragm 204.

If microphone 302 is fabricated in silicon, then reasonable parameters for microphone 302 may be: l=approximately 100 μm; d=1 μm; h=5 μm; and N=100. The diaphragm 204 (FIG. 2*a*) is assumed to deflect approximately 20 nM for every 1 Pascal sound pressure. Assuming a feedback capacitor of approximately 1.5 pf, the output voltage Vo will be:

$$V_0 \cong V_b \times 0.0043 \text{ volts/Pascal.} \tag{8}$$

Using a bias voltage Vb 304 of 10 volts provides an output sensitivity of approximately 43 mV/Pascal. It will be recognized that if the inter-finger gap d 212 (FIG. 2*b*) is reduced to approximately 0.1 μm, a value that is obtainable using currently known silicon microfabrication techniques, then the output voltage Vo 310 may be increased by a factor of 10. In other words, the voltage Vb 304 may be reduced to 1 volt and, with the 0.1 μm gaps, the same 43 mv/Pascal output sensitivity may be obtained.

It should be noted that while a significant advantage of this invention is that the bias voltage does not affect the dynamic response of the diaphragm in the x direction, one must still be careful to design the fingers so that they have sufficient stiffness to avoid the situation where the neutral position of the fingers is made to be unstable by the use of too large a value of Vb. In this case, the fingers may deflect such that they touch each other and reduce the performance of the capacitive sensing system. However, it is important to emphasize that the design requirements for the stiffness of the fingers are uncoupled from the requirements that determine the compliance of the diaphragm; it is desirable to use stiff fingers along with a diaphragm that is very compliant in the x direction so that the diaphragm is highly responsive to sound.

In addition to considering the effect of the electrostatic forces on the stability of the fingers, it is not possible to use an arbitrarily large bias voltage because the finite break-down voltage of the air in the gap between the fingers may allow current to flow across the gap which would have a dramatic affect on the electronic signal.

Figure 5:
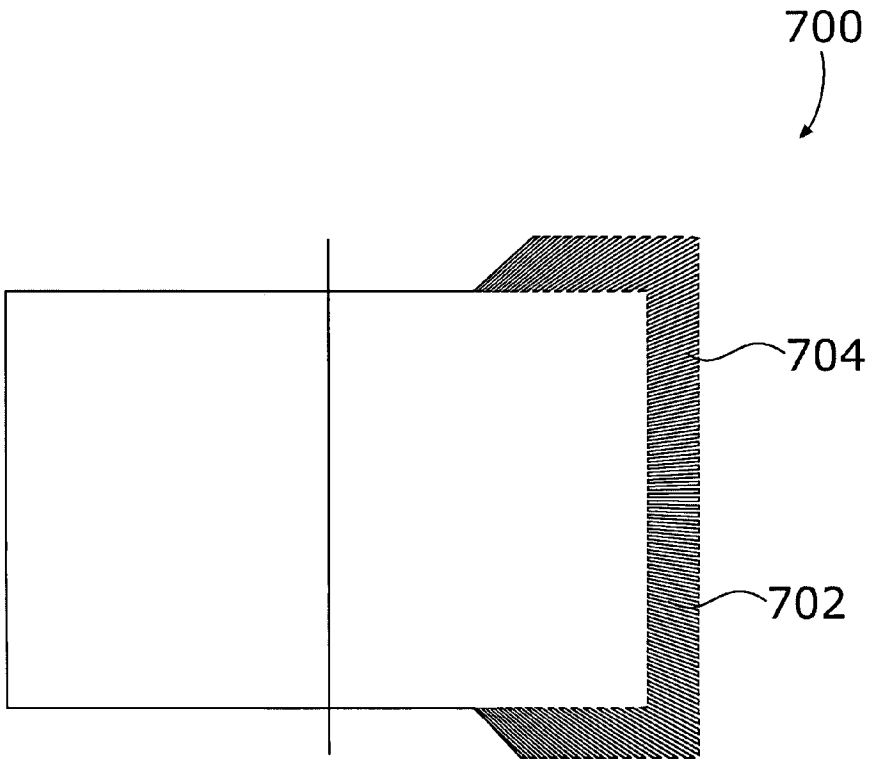
FIG. 5 is a schematic plan view of a typical diaphragm in accordance with the present invention having a number of fingers disposed thereupon.
Figure 6:
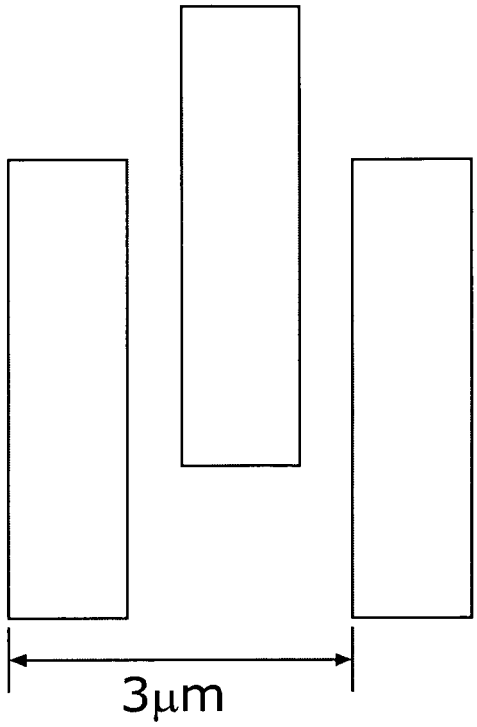
FIG. 6 is an end view of three interdigitated fingers.
Figure 7:
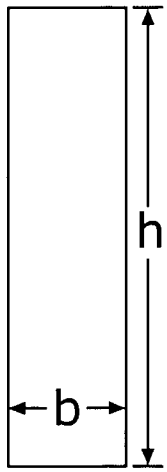
FIG. 7 is an end view of a single finger.

Referring now to FIG. 5, there is shown a schematic representation of a typical diaphragm 700 in accordance with the present invention. Diaphragm 700 has a number of fingers N disposed in a finger region at one end of the diaphragm. Assuming a period of approximately 3 μm (FIG. 6), the number N of fingers which may be placed at each end of the diaphragm may be estimated as:

$$N = \frac{Ylength + \frac{2Xlength}{4}}{3\ \mu\text{m}}. \tag{27}$$

If Xlength is approximately 2000 μm and Ylength is approximately 1000 μm, then $$N = \frac{2000 \times 10^{-6}}{3 \times 10^{-6}} = 666.$$

A practical microphone diaphragm in accordance with the inventive concepts may be microfabricated in polysilicon.

Figure 8A:
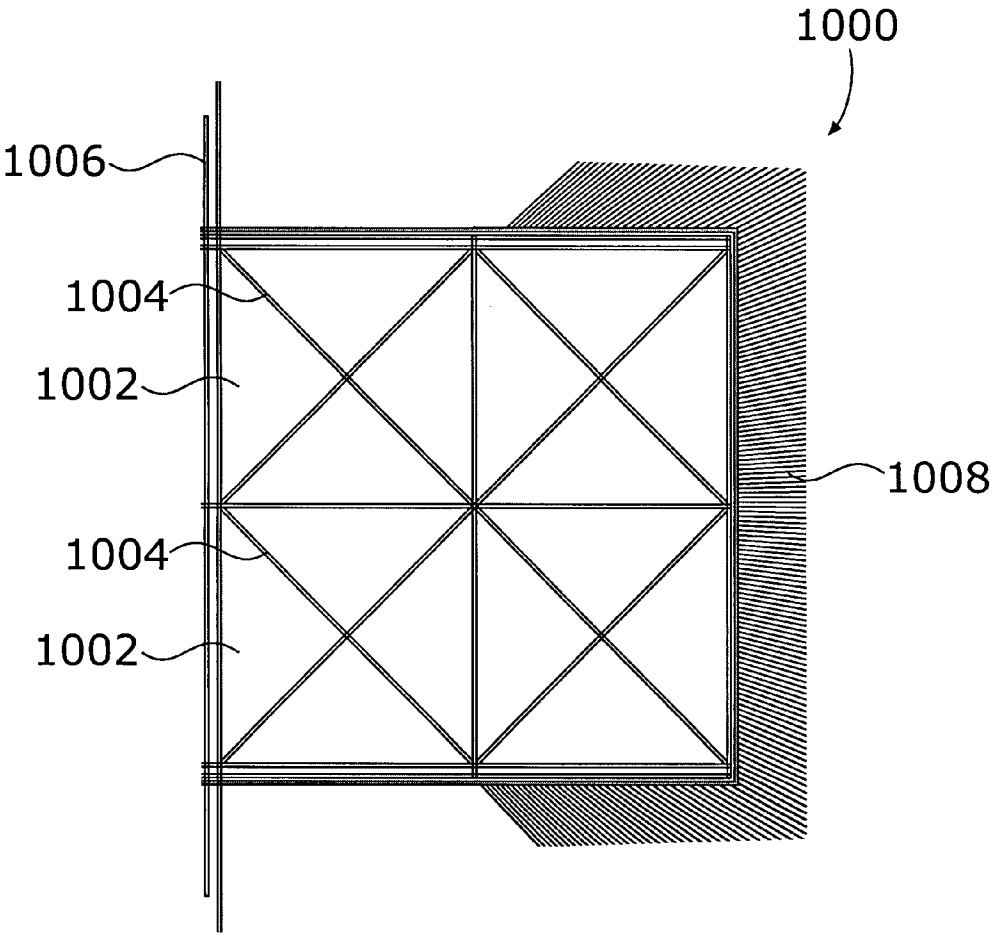
FIGS. 8*a* and 8*b* are plan schematic views of omnidirectional and differential diaphragms, respectively, in accordance with the invention.

Referring now to FIG. 8*a* there is shown a plan schematic view of a diaphragm in accordance with the present invention suitable for use in an omnidirectional microphone, generally at reference number 1000. A rigid silicon diaphragm 1002 has stiffening ribs 1004 disposed on a least one face thereof. Diaphragm 1002 is free to rotate about a pivot or hinge 1006. Such a diaphragm is described in detail in application Ser. No. 10/302,528, which is included herein by reference. In alternate embodiments, diaphragm 1002 may be resiliently supported by mechanisms other than a hinge or pivot 1006. For example, diaphragm 1002 could be supported by one or more springs or other resilient structures, not shown, at or near corners of diaphragm 1002. Such springs could support diaphragm, 1002 from below in compression or could support diaphragm 1002 from above in tension. In yet other embodiments, diaphragm 1002 could be supported on a resilient pad (e.g., a foam pad). The inventive diaphragm with its interdigitated finger structure is not intended to be limited to a particular support structure or method but is seen to include any means for resiliently supporting diaphragm 1002.

A series of sensing fingers 1008 is disposed radially around a portion on the perimeter of diaphragm 1002. Fingers 508 have been described hereinabove. Fingers 1008 are adapted for interdigitation with corresponding fingers, not shown, on a surrounding, fixed frame, not shown.

It will be recognized that radial disposition of the fingers eliminates potential interference between the diaphragm fingers 1008 and the interdigitated fingers on a surrounding substrate, not shown, caused by strain in the diaphragm 1002. If a diaphragm 1002 can be fabricated and supported in a manner wherein strain is effectively eliminated, finger arrangements other than radial disposition may also be used. Consequently, the inventive concept is not limited to radial finger disposition but is seen to encompass any interdigitated finger arrangement.

Figure 8B:
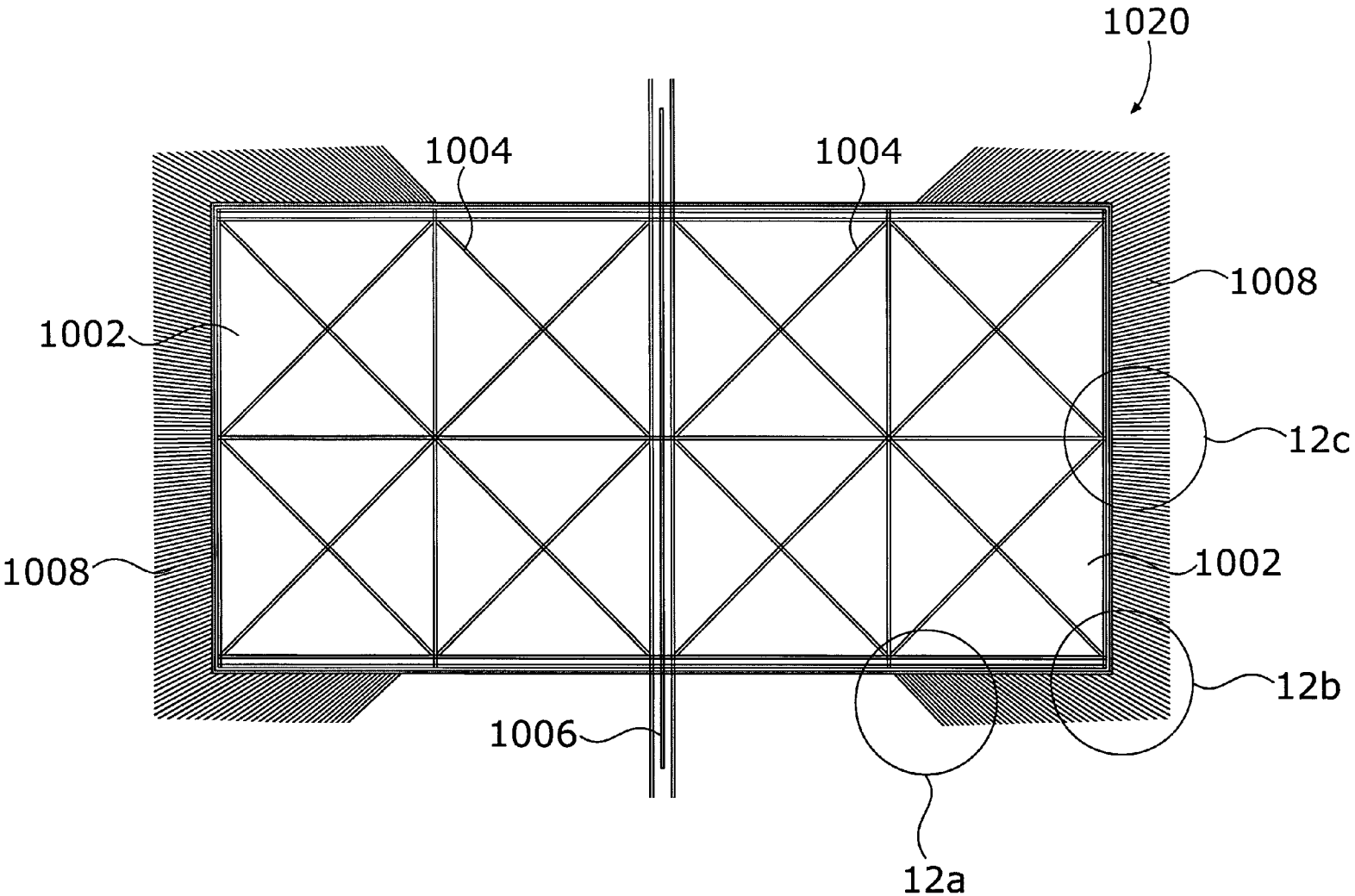

FIG. 8*b* shows a plan schematic diagram of a diaphragm in accordance with the present invention suitable for use in a differential microphone, generally at reference number 1020. A similar differential microphone is the subject of U.S. Pat. No. 6,788,796, included herein by reference. The structure of diaphragm 1020 is similar to omnidirectional diaphragm 1000 (FIG. 8*a*) except that the pivot 1006 is disposed in the middle of diaphragm 1020 and fingers 1008 are disposed at each end thereof.

Figure 9A:
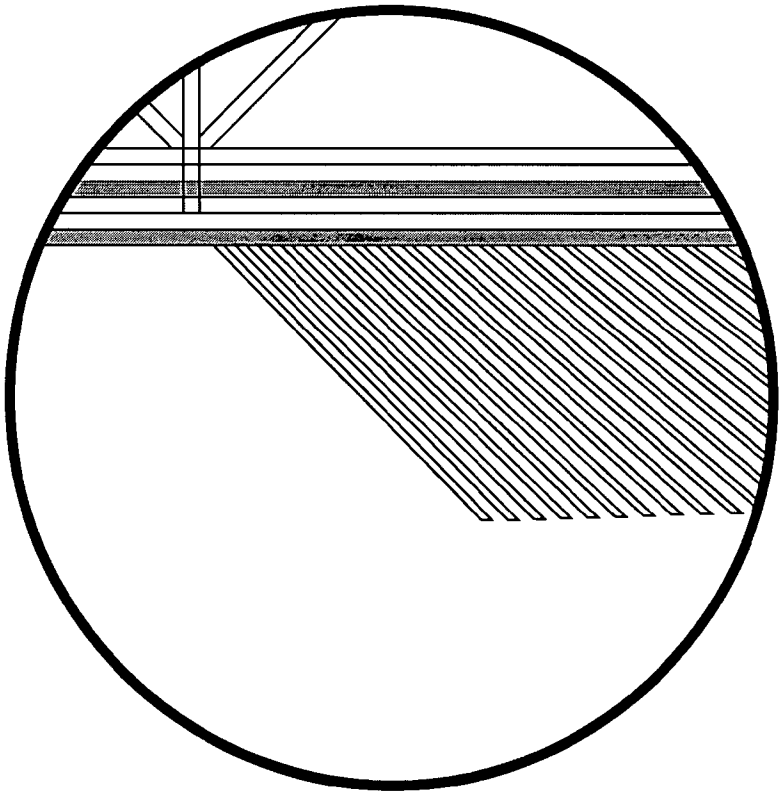
FIGS. 9*a*-9*c* are, respectively, schematic plan views of the diaphragm of FIG. 8*b* and enlarged views of portions thereof.
Figure 9B:
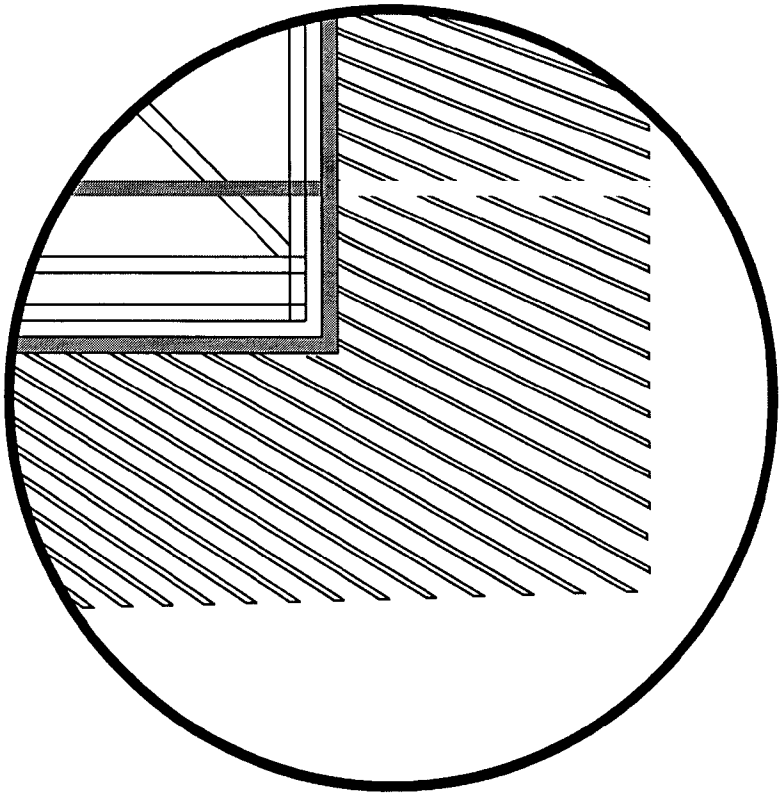
Figure 9C:
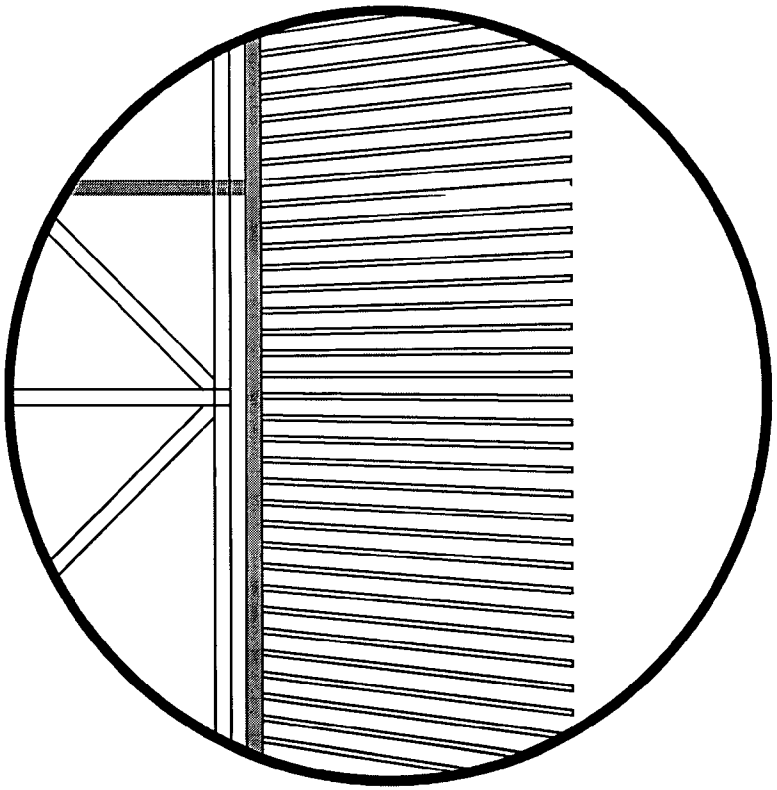

Referring now to FIGS. 9*a*-9*c*, there are shown enlarged views of three regions of diaphragm 1002 identified in FIG. 8*b*.

It will be recognized that all fingers 1008 are disposed radially from respective geometric centers of diaphragms 1000 (FIG. 8) and 1020 such that as each diaphragm 1000, 1020 moves in response to in-plane stresses and strains that occur during fabrication, not shown, fingers 1008 each move in substantially a single plane relative to their corresponding, fixed fingers. The radial arrangement of the fingers prevents them from getting stuck together when the diaphragm shrinks or expands during fabrication. The fingers radiate from a point on the diaphragm that doesn't move relative to the surrounding substrate. While substantially rectangular diaphragms (FIGS. 8*a*, 8*b*) have been chosen for purposes of disclosure, the inventive concept of radially disposed fingers may be applied to diaphragms of other shapes. Consequently, the invention is not considered limited to such rectangular diaphragms chosen for purposes of disclosure but rather is seen to encompass diaphragms of any other shape. Also, in the embodiments chosen for purposes of disclosure, fingers are said to radiate from a geometric center of the diaphragm, it will be recognized that fingers may radiate radially relative to any point on the diaphragm that remains fixed relative to the surrounding substrate with which such fingers are interdigitated. Consequently, the inventive concept is not considered limited to embodiments wherein fingers radiate only from a geometric center of the diaphragm. It should also be noted that the orientation of the fingers may be determined by other considerations if the shrinkage or expansion of the diaphragm relative to the substrate is not significant relative to the distance between the fingers.

In a typical realization of a microphone in accordance with the present invention, fingers 1008 may be approximately 100 μm in length and may be spaced approximately 1.0 μm (i.e., that have approximately a 3 μm period).

While a capacitance microphone configuration has been described for purposes of disclosure, it is possible to create microphones or other similar devices using sensing methods other than capacitance. For example, a light source may be modulated by movement of the diaphragm fingers and used to generate an output signal. Optical interferometry techniques may also be used to generate an output signal representative of the movement of a diaphragm by sound pressure, vibration, or any other actuating force acting thereupon. Consequently, the inventive concept is not seen limited to capacitive sensing microphones but rather is seen to include any microphone or similar device having fingers disposed around a perimeter of diaphragm regardless of the technology used to sense diaphragm movement.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A miniature microphone, comprising:

a) a diaphragm comprising a thin, rigid substrate having a pair of opposing surfaces and a perimeter;

b) a resilient attachment attached to said diaphragm;

c) a plurality of fingers rigidly attached to said diaphragm and projecting outward from said perimeter;

d) a structure surrounding said diaphragm and having a plurality of fixed fingers disposed in a spaced apart, interdigitated relationship with said plurality of fingers of said diaphragm;

e) a sensor adapted to produce an output signal responsive to a relative movement of said diaphragm and said structure.

2. A diaphragm for use in a miniature microphone, comprising:

a) a thin, rigid, substrate having a perimeter; and b) a first plurality of fingers rigidly attached to said substrate and projecting outwardly from said perimeter, said first plurality of fingers being adapted for interaction with a corresponding second plurality of fixed fingers disposed external to said substrate and proximate said first plurality of fingers.

3. The diaphragm for use in a miniature microphone as recited in claim 2, further comprising:

c) a resilient attachment disposed between a point along said perimeter.

4. The diaphragm for use in a miniature microphone as recited in claim 3, wherein said first plurality of fingers project radially from said perimeter with respect to a predetermined point on one of said opposing surfaces of said substrate.

5. The diaphragm for use in a miniature microphone as recited in claim 4, wherein said predetermined point on said substrate is a point which remains substantially fixed relative to said second plurality of fixed fingers during said movement.

6. The diaphragm for use in a miniature microphone as recited in claim 5, wherein said predetermined point on said substrate comprises a geometric center of said substrate.

7. The diaphragm for use in a miniature microphone as recited in claim 2, further comprising a supporting structure adapted to resiliently support said substrate for movement in response to acoustic waves with respect to said second plurality of fixed fingers, comprising at least one of:

a hinge affixed to said substrate at a predetermined point on said perimeter, a spring attached to said substrate, and a resilient pad supporting at least a portion of said substrate.

8. The diaphragm for use in a miniature microphone as recited in claim 3, wherein said resilient attachment point comprises a pair of hinge attachment points, each being disposed along said perimeter.

9. The diaphragm for use in a miniature microphone as recited in claim 3, wherein said first plurality of fingers projects from only a portion of said perimeter.

10. The diaphragm for use in a miniature microphone as recited in claim 3, further comprising:

d) a rib structure disposed on a flat surface of said substrate.

11. The diaphragm for use in a miniature microphone as recited in claim 3, wherein said diaphragm is substantially rectangular.

12. The diaphragm for use in a miniature microphone as recited in claim 2, further comprising a resilient support for supporting said substrate with respect to said second plurality of fixed fingers, and an electrostatic sensor adapted to produce a signal responsive to a movement of said first plurality of fingers with respect to said second plurality of fixed fingers, and wherein said electrostatic sensor operates substantially without inducing a force inducing displacement of said substrate with respect to said second plurality of fixed fingers.

13. The diaphragm for use in a miniature microphone as recited in claim 3, further comprising a structure surrounding said diaphragm and having the second plurality of fixed fingers disposed thereon, in a spaced apart, interdigitated relationship with said first plurality of fingers.

14. The diaphragm for use in a miniature microphone as recited in claim 13, further comprising a sensor adapted to produce an output signal responsive to a relative movement of first plurality of fingers with respect to said second plurality of fixed fingers.

15. The diaphragm for use in a miniature microphone as recited in claim 2, wherein said diaphragm is supported for movement in response to acoustic waves with respect to a fixed structure supporting the second plurality of fixed fingers, to thereby change an electrical capacitance between the first plurality of fingers and the second fixed plurality of fingers.

16. The diaphragm for use in a miniature microphone as recited in claim 2, further comprising an amplifier adapted to produce an electronic signal in response to movement of said diaphragm with respect to the second plurality of fixed fingers.

17. The diaphragm for use in a miniature microphone as recited in claim 16, wherein at least a portion of said diaphragm, and said second plurality of fixed fingers are conductive, and are provided with electrical connections adapted to maintain a bias voltage therebetween.

18. The diaphragm for use in a miniature microphone as recited in claim 2, wherein said diaphragm is supported for movement in response to acoustic waves with respect to a fixed structure supporting the second plurality of fixed fingers, further comprising an optical interferometer adapted to generate a signal representative of the movement of said diaphragm.

* * * * *